US008225514B2

(12) United States Patent
Guip et al.

(10) Patent No.: US 8,225,514 B2
(45) Date of Patent: Jul. 24, 2012

(54) MANUALLY GUIDED IMPLEMENT

(75) Inventors: Andreas Guip, Waiblingen (DE); Johannes Menzel, Wernau (DE); Helmut Lux, Waiblingen (DE); Günter Wolf, Oppenweiler (DE)

(73) Assignee: Andreas Stihl AG & Co., KG (DE)

( * ) Notice: Subject to any disclaimer, the term of this patent is extended or adjusted under 35 U.S.C. 154(b) by 614 days.

(21) Appl. No.: 12/115,425

(22) Filed: May 5, 2008

(65) Prior Publication Data

US 2008/0276469 A1 Nov. 13, 2008

(30) Foreign Application Priority Data

May 11, 2007 (DE) ..... 10 2007 022 115

(51) Int. Cl.
*B27B 17/02* (2006.01)
*B25D 17/24* (2006.01)

(52) U.S. Cl. ..... 30/381; 30/383; 173/162.2

(58) Field of Classification Search ..... 38/381, 38/383; 173/162.2, 163.1, 210, 211, 212; 16/422, 437, DIG. 40, DIG. 41, 430, 431, 16/436; 15/143.1, 144.1–144.4, 145, 229.2, 15/246; 29/894.1, 894, 450, 521–523; 74/543, 74/551.1, 551.9, 505; 403/24, 384, 392; 267/219, 137, 141, 153, 136, 140.11
See application file for complete search history.

(56) References Cited

U.S. PATENT DOCUMENTS

| | | | | | |
|---|---|---|---|---|---|
| 3,542,095 | A * | 11/1970 | Hammond et al. | ..... | 30/381 |
| 3,728,793 | A * | 4/1973 | Makinson et al. | ..... | 30/383 |
| 4,141,143 | A * | 2/1979 | Hirschkoff et al. | ..... | 30/381 |
| 4,202,096 | A * | 5/1980 | Nagashima | ..... | 30/381 |
| 5,025,870 | A * | 6/1991 | Gantner | ..... | 173/162.2 |
| 5,046,566 | A * | 9/1991 | Dorner et al. | ..... | 173/162.2 |
| 5,361,500 | A * | 11/1994 | Naslund et al. | ..... | 30/381 |
| 5,697,456 | A * | 12/1997 | Radle et al. | ..... | 173/162.2 |
| 7,219,433 | B2 * | 5/2007 | Gorenflo et al. | ..... | 30/383 |
| 2002/0073558 | A1 * | 6/2002 | Tajima et al. | ..... | 30/381 |
| 2005/0138776 | A1 * | 6/2005 | Guip et al. | ..... | 16/421 |
| 2006/0000438 | A1 * | 1/2006 | Wolf et al. | ..... | 123/198 E |
| 2006/0219418 | A1 | 10/2006 | Arakawa et al. | | |
| 2009/0095497 | A1 * | 4/2009 | Zimmermann | ..... | 173/162.2 |

* cited by examiner

*Primary Examiner* — Ghassem Alie
(74) *Attorney, Agent, or Firm* — Robert Becker; Robert Becker & Assoc.

(57) ABSTRACT

A manually guided implement, such as a power saw, a cut-off machine, or the like, having a drive motor for driving a tool of the implement. The drive motor has a drive shaft that is rotatably driven about an axis of rotation. The implement has a handle on which is disposed at least one control handle for the drive motor. Formed between the handle and the drive motor is a vibration space that is spanned by at least one anti-vibration element, at least one of which includes a coil spring, the longitudinal axis of which is disposed approximately perpendicular to a longitudinal plane of the implement. The vibration space is spanned by at least one connecting element, the longitudinal axis of which is inclined relative to a transverse plane of the implement that is disposed perpendicular to the longitudinal plane.

19 Claims, 3 Drawing Sheets

MANUALLY GUIDED IMPLEMENT

The instant application should be granted the priority date of May 11, 2007, the filing date of the corresponding German patent application DE 10 2007 022 155.2.

BACKGROUND OF THE INVENTION

The present invention relates to a manually guided implement, such as a power saw, a cut-off machine, or the like.

With manually guided implements, it is known to mount the drive motor in such a way that it is vibration-neutralized from the handles that serve to guide the implement. It is also known to use anti-vibration elements that include coil springs. Anti-vibration elements having a coil spring result in a good vibration dampening. Anti-vibration elements that include a coil spring are customarily horizontally disposed, as viewed in the working direction, between the drive motor and the handle. Such an arrangement of the anti-vibration elements is known, for example, from U.S. Pat. No. 7,219,433.

During operation, handle and drive motor carry out relative movements in the plane perpendicular to the longitudinal axis of the anti-vibration elements. In this direction, coil springs can be loaded to only a limited extent. For this reason, stops or abutments must be additionally provided for limiting the relative movements in this direction.

It is therefore an object of the present invention to provide a manually guided implement of the aforementioned general type that has a straightforward construction.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
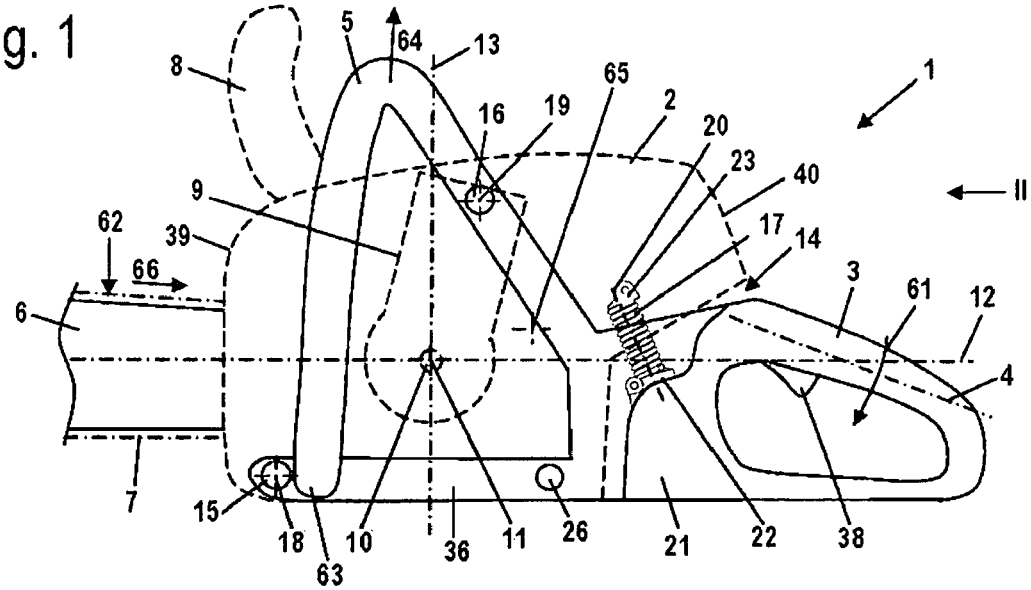
FIG. 1 is a side view of a power saw.

The manually guided implement of the present application comprises a drive motor for driving a tool of the implement, wherein the drive motor is provided with a drive shaft that is rotatably driven about an axis of rotation; a handle on which is disposed at least one control element for the drive motor, wherein the implement has an imaginary longitudinal plane that extends perpendicular to the axis of rotation and a longitudinal axis of the handle is disposed in the longitudinal plane, and wherein the implement has an imaginary transverse plane that extends perpendicular to the longitudinal plane and the axis of rotation of the drive shaft is disposed in the transverse plane; at least one anti-vibration element, wherein a vibration space is formed between the handle and the drive motor and is spanned by the anti-vibration element, and wherein at least one of the anti-vibration elements includes a coil spring having a longitudinal axis that extends approximately perpendicular to the imaginary longitudinal plane of the implement; and at least one connecting element having a longitudinal axis that is inclined relative to the imaginary transverse plane of the implement, wherein the vibration space is spanned by the connecting element.

The connecting element of the implement of the present application delimits the relative movements between drive motor and handle in a straightforward manner. Consequently, an impermissible movement of the anti-vibration elements transverse to their longitudinal direction is easily avoided. In particular when the connecting element is embodied as an anti-vibration element, the inclined arrangement of the longitudinal axis of the connecting element results in a good vibration dampening of the entire system. At the same time, the connecting element can be easily integrated into the existing installation space, resulting in a small overall size of the implement.

The longitudinal axis of the connecting element is the axis that connects the two securement points of the connecting element. For an anti-vibration element having a coil spring, the longitudinal axis is the longitudinal central axis of the coil spring, in other words, the axis about which the coils of the coil spring are wound.

The angle between the longitudinal axes of the connecting element and of the transverse plane is advantageously less than 80°. The angle is in particular less than 60°, and is advantageously from about 10° to about 45°. With this arrangement, good vibration dampening characteristics of the implement result especially if the connecting element includes an anti-vibration element. At the same time, the relative movement of drive motor and handle transverse to the longitudinal axis of the horizontally disposed anti-vibration element is easily limited.

The handle is advantageously a rear handle, and the connecting element is advantageously disposed on that side of the transverse plane that faces the rear handle. The operator introduces a greatest part of the operating forces via the rear handle. In particular if the implement is a power saw, during operation, to carry out a back hand cut, pressure is applied to the rear handle and a tubular handle of the implement is pulled. These forces counteract the cutting forces on the tool. As a result, the rear handle moves downwardly relative to the drive motor and thus expands or widens the vibration space. This relative movement is limited by the connecting element. Due to the fact that the connecting element is disposed on that side of the transverse plane that faces the rear handle, there results an arrangement of the connecting element in the region of the greatest relative movement.

The implement advantageously includes a housing in which the drive motor is disposed. A first end of the connecting element is in particular connected with the handle while the second end is connected with the housing of the implement. The connecting element is thus connected with the drive motor that is disposed in the housing via the housing.

The implement can have a tubular handle for guiding the implement; the tubular handle extends over the housing adjacent to a front end of the housing that faces the tool. The tubular handle and the rear handle portion of a handle housing of the implement are advantageously securely connected to one another, especially by being screwed together. The implement is accordingly composed of a handle housing and a housing in which the drive motor is disposed. These two housings are interconnected via anti-vibration elements and the connecting element in a vibration-neutralized manner. The first end of the connecting element is advantageously secured to the handle housing in a region between the tubular handle and the rear handle.

To achieve a good vibration dampening, at least two anti-vibration elements are disposed perpendicular to the longitudinal plane of the implement, whereby a first anti-vibration element is disposed adjacent to the front end of the tubular handle, and one end of a second anti-vibration element is secured to the tubular handle. A straightforward construction of the implement, with good vibration dampening characteristics, results if the connecting element is embodied as an anti-vibration element. The anti-vibration element that is formed as the connecting element is consequently not disposed horizontally, in other words perpendicular to the longitudinal plane, but rather is disposed at an angle. In this way good vibration dampening characteristics can be achieved, while at the same time achieving a limitation of the transverse load of the two horizontally disposed anti-vibration elements. Good vibration dampening characteristics result in particular if the first end of the anti-vibration element that forms the connecting element is secured to the handle housing further from the transverse plane than is the second end, which is secured to the housing. Thus, the upwardly facing side of the anti-vibration element, in the customary disposition of the implement, is inclined toward the front. As a result, the forces that occur during operation can be effectively absorbed. In addition, the installation space that is available can be well utilized.

Good dampening characteristics result in particular if the anti-vibration element that forms the connecting element includes a coil spring.

The connecting element can include means to protect against over extension. Such means delimit the path that the housing and handle housing can travel relative to one another. The means to protect against over extension is advantageously disposed in the interior of the coil spring of an anti-vibration element that forms the connecting element. The connecting element thus includes not only an anti-vibration element but also a means to protect against over extension. However, it would also be possible for the connecting element to be formed only by an anti-vibration element, in other words, in particular only by a coil spring. The coil spring also delimits the path of travel between housing and handle housing. Due to the spring characteristics of the anti-vibration element, there results a soft delimitation, since the path is a function of the active force, and at greater acting forces a greater relative movement is possible. In contrast, the means to protect against over extension represents an absolute delimitation of the relative path independent of the forces that are active. The connecting element is advantageously embodied as a separate means to protect against over extension, and includes a safety cable. Where the connecting element is embodied as a separate means to protect against over extension, it would also be possible to provide an arrangement where the connecting element is not inclined relative to the transverse plane of the implement. The safety cable delimits the possible maximum relative path in a straightforward manner.

The safety cable is advantageously disposed at least partially in the direction of the operating force that during operation acts on the rear handle. The safety cable is advantageously oriented in the direction of the operating force. The safety cable is expediently made of polymeric material, in particular aramid. For a simple securement of the safety cable, a connection fitting can be provided at each end of the safety cable. The connection fittings are advantageously made of polymeric material and are extruded or injected on the safety cable. A reliable securement results when the polymeric material of the connection fitting is molded about the safety cable.

A first receiving means for the first connection fitting of the safety cable is advantageously formed on the handle housing, and a second receiving means for the second connection fitting of the safety cable is advantageously formed on the housing. A straightforward mounting of the means to protect against over extension is possible if the first connection fitting is cylindrical and the second connection fitting has a multi-sided cross-section, whereby the diameter of the first connection fitting is less than the smallest diameter of the multiple sides of the second connection fitting. The multi-sided cross-section of the second connection fitting ensures that the safety cable cannot twist during operation. Due to the fact that the first connection fitting has a smaller diameter than the smallest diameter of the second connection fitting, the first connection fitting can be inserted through the receiving means of the second connection fitting and can be fixed in the receiving means for the first connection fitting. This results in a straightforward and reliable fixation of the means to protect against over extension.

Further specific features of the present invention will be described in detail subsequently.

DESCRIPTION OF SPECIFIC EMBODIMENTS

Referring now to the drawings in detail, as an exemplary embodiment for a manually-guided implement, FIG. 1 shows a power saw 1. However, the present invention can also be used with other manually-guided, and in particular portable, implements, such as cut-off machines or the like. The power saw 1 has a housing 2 in which is disposed a drive motor 9, which is in particular embodied as an internal combustion engine, and is advantageously a single cylinder engine. The drive motor 9 is in particular a two-cycle engine or a mixture-lubricated four-cycle engine. The drive motor 9 has a drive shaft 10 that, when the drive motor 9 is embodied as an internal combustion engine, is the crankshaft, and is rotatably driven about an axis of rotation 11. The drive shaft 10 rotatably drives a non-illustrated pinion. The power saw 1 has a guide bar 6 on which a saw chain 7 circulates. The saw chain 7 is driven in a circulating manner by the drive shaft 10 via the non-illustrated pinion. The guide bar 6 extends in a forward direction at a front end 39 of the housing 2. A hand guard 8 extends on the upper side of the housing 2. In this connection, the term "upper side" relates to the upwardly facing side in the position of the power saw 1 shown in FIG. 1. This position of the power saw 1 results when the power saw is placed upon the ground. When vertical cuts are being carried out, this corresponds approximately to the working position of the power saw 1.

A rear handle 3 and a tubular handle 5 are provided for guiding the power saw 1. The tubular handle 5 extends over the housing 2 of the power saw 1 adjacent to the front end 39.

The rear handle 3 extends from the back end 40 of the housing 2, which is disposed remote or facing away from the front end 39. A control element 38 for the drive motor 9 is disposed on the rear handle 3. The control element 38 is embodied as a throttle trigger. The rear handle 3 is rigidly connected with the tubular handle 5 and together with the tubular handle forms a handle housing 21. The handle housing 21 is mounted in a vibration-neutralized manner relative to the housing 2, which has the drive motor 9. For this purpose, anti-vibration elements 15, 16 and 17 are provided that each have one end secured to the handle housing 21 and the other end secured to the housing 2 or to the drive motor 9. A vibration gap or space 14 is formed between the handle housing 21 and the housing 2, and is bridged or spanned by the anti-vibration elements 15, 16, 17. To distinguish the assemblies that are movable relative to one another, in FIGS. 1 and 2 the handle housing 21 is shown in solid lines, and the housing 2 is shown in dashed lines.

The rear handle 3 has a longitudinal axis 4 that extends parallel to the plane of the guide bar 6 and that in the position of the power saw 1 shown in FIG. 1 extends toward the front and upwardly. The power saw 1 has a longitudinal central axis 12 that also extends parallel to the plane of the guide bar 6. When the power saw 1 is placed upon the ground, the longitudinal central axis 12 extends parallel to the ground, in other words, horizontally. The longitudinal central axis 12 and the longitudinal axis 4 define the longitudinal plane 60 of the power saw 1 shown in FIG. 2. The imaginary longitudinal plane 60 extends parallel to the plane of the guide bar 6 and centrally divides the rear handle 3 in the longitudinal direction. The longitudinal central axis 12 intersects the axis of rotation 11 of the drive shaft 10. The power saw 1 has an imaginary transverse plane 13 that extends perpendicular to the longitudinal plane 60 and contains the axis of rotation 11 of the drive shaft 10.

Figure 2:
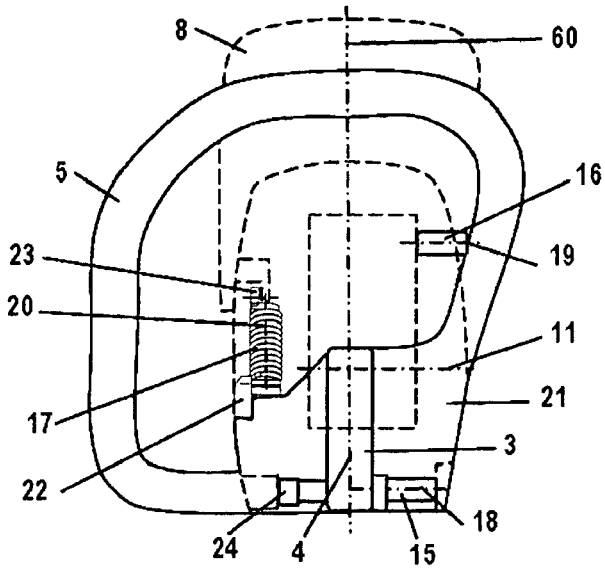
FIG. 2 is a view of the power saw taken in the direction of the arrow II in FIG. 1.

As shown in FIGS. 1 and 2, a first anti-vibration element 15 is disposed between the housing 2 and the handle housing 21. The first anti-vibration element 15 is disposed adjacent to a front, lower end 63 of the tubular handle 5. The first anti-vibration element 15 has a longitudinal axis 18 that extends parallel to the transverse plane 13 and perpendicular to the longitudinal plane 60. Thus, in the position of the power saw 1 shown in FIG. 1, the first anti-vibration element 15 is disposed horizontally.

A second anti-vibration element 16 extends between the tubular handle 5 and the drive motor 9, and is secured in an upper region of the drive motor 9. The second anti-vibration element 16 has a longitudinal axis 19 that extends parallel to the longitudinal axis 18 of the first anti-vibration element 15, parallel to the transverse plane 13, and perpendicular to the longitudinal plane 60. Thus, in the position of the power saw 1 shown in FIGS. 1 and 2, the second anti-vibration element 16 is also disposed horizontally. The two anti-vibration elements 15 and 16 can also be inclined relative to the longitudinal plane 60 by a slightly smaller angle than 90°, so that there results an approximately perpendicular arrangement relative to the longitudinal plane 60.

A third anti-vibration element 17, as a connecting element, is provided between the handle housing 21 and the housing 2. The third anti-vibration element 17 has a first end 22 that is secured to the handle housing 21 in a region between the rear handle 3 and the tubular handle 5. A second end 23 of the third anti-vibration element 17 is fixed on the housing 2. The third anti-vibration element 17 has a longitudinal axis 20, which is inclined relative to the transverse plane 13. As shown in FIG. 2, the longitudinal axis 20 extends parallel to the longitudinal plane 60.

Figure 3:
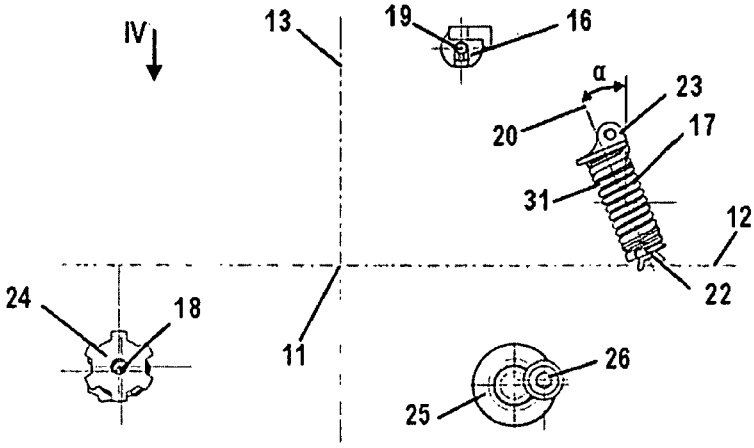
FIG. 3 is a view of the anti-vibration elements and abutments of the power saw of FIG. 1 with the arrangement of the power saw shown in FIG. 1.
Figure 4:
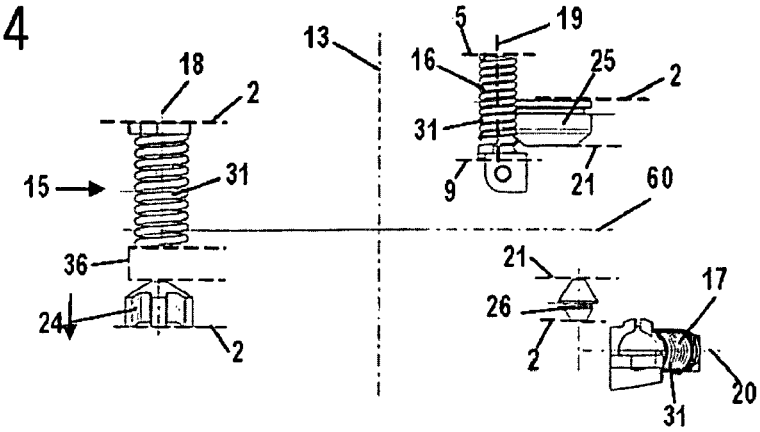
FIG. 4 shows the arrangement of the anti-vibration elements and abutments viewed in the direction of the arrow IV in FIG. 3.

FIGS. 3 and 4 show the arrangement of the anti-vibration elements 15, 16 and 17 without the housing 2 and the handle housing 21. To make the arrangement of the anti-vibration elements and the abutments more apparent, the components between which the anti-vibration elements and the abutments are effective are schematically indicated in FIG. 4. As shown in FIG. 3, the longitudinal axis 20 of the third anti-vibration element 17 forms an angle $\alpha$, which is less than 90°, with the transverse plane 13. The angle $\alpha$ is advantageously less than 80°, and in particular less than 60°. An angle $\alpha$ of approximately 10° to approximately 45° is particularly advantageous. In this connection, the anti-vibration element 17 is inclined relative to the transverse plane 13 in such a way that the first end 22 of the anti-vibration element 17 is spaced further from the transverse plane 13 than is the second end 23 of the anti-vibration element 17. As shown in FIGS. 3 and 4, the third anti-vibration element 17 includes a coil spring 31. As shown in FIG. 1, the handle housing 21 has a crosspiece 36, which connects the front, lower end 63 of the tubular handle 5 with the rear handle 3 at an underside of the housing 2. Abutments or stops 25 and 26 are provided on both sides of the crosspiece 36 between the crosspiece and the housing 2. The abutments 25, 26 delimit the relative movements of the crosspiece 36 relative to the housing 2, in particular perpendicular to the longitudinal plane 60. The abutments 25 and 26 could, in this lower region, also effect a limitation of movement parallel to the longitudinal plane 60.

As shown in FIGS. 3 and 4, the anti-vibration elements 15, 16 and 17 each have a coil spring 31. The first anti-vibration element 15, in addition to the coil spring 31, includes a dampening element 24 that can, for example, be made of foamed polymeric material.

Figure 5:
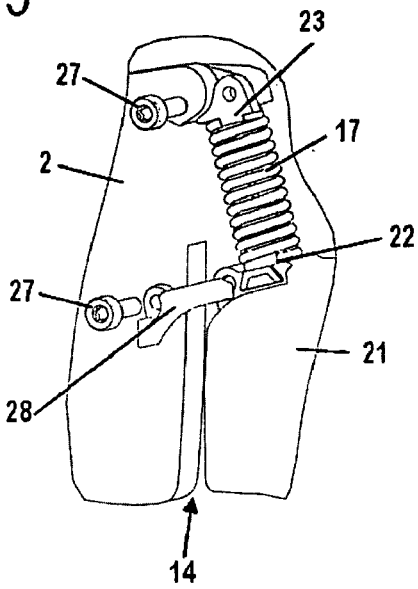
FIG. 5 is a perspective view of the third anti-vibration element during assembly.
Figure 6:
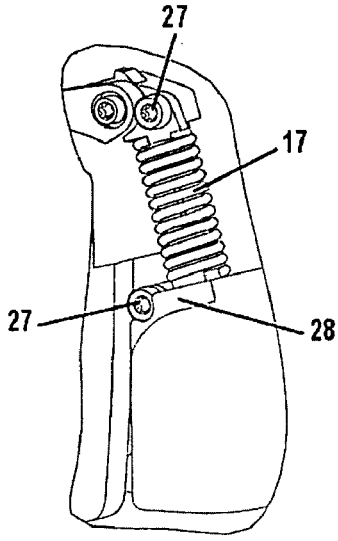
FIG. 6 is a perspective view of the third anti-vibration after assembly.
Figure 7:
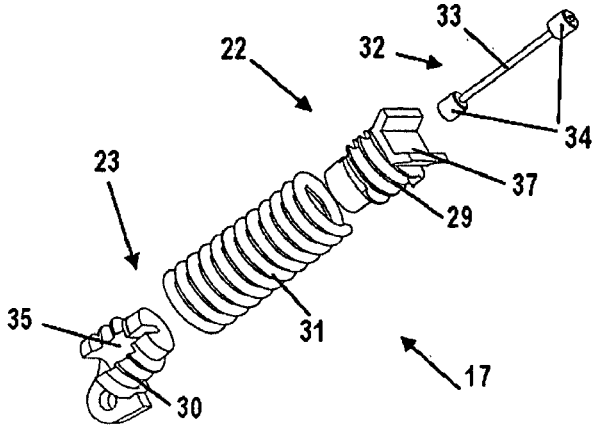
FIG. 7 is an exploded perspective view of the third anti-vibration element.

As shown in FIGS. 5 and 6, the first end 22 of the third anti-vibration element 17 is securely fastened to the handle housing 21 via a mounting screw 27, while the second end 23 thereof is securely fastened to the housing 2 via a mounting screw 27. Provided at the first end 22 of the anti-vibration element 17 is a cover 28, which conceals or covers a profiled receiving member 37, which is shown in FIG. 7. The profiled receiving member 37 is disposed on a first threaded plug 29, which is threaded into the coil spring 31 at the first end 22. Provided at the opposite, second end 23 of the anti-vibration element 17 is a second threaded plug 30. The profiled receiving member 37 extends over a crosspiece of the handle housing 21, resulting in a defined position of the third anti-vibration element 17.

As shown in FIG. 7, the third anti-vibration element 17 has a means 32 to protect against over extension. The means 32 includes an anchor or safety cable 33, on each end of which is disposed a respective connection fitting 34. The safety cable 33 can, for example, be a shear resistant cable, for example a wire cable or the like. However, a wire strap or an element made of polymeric material can also be provided. One end of the means 32 to protect against over extension is disposed on the first threaded plug 29, while the other end is disposed in a slot or other receiving means 35 of the second threaded plug 30. As a result, the handle housing 21 is connected to the housing 2 not only via the coiled spring but also via the safety cable 33. The safety cable 33 limits the path that the handle housing 21 can travel relative to the housing 2 in the region of the rear handle 3. The third anti-vibration element 17 can also be an anti-vibration element that does not have a means 32 to protect against over extension. In such a case, the coil spring 31 of the anti-vibration element 17 delimits the relative path between housing 2 and handle housing 21.

The forces that act upon the power saw 1 during operation are schematically illustrated in FIG. 1. Acting on the guide bar 6 is a counter force 62 that is applied by the workpiece that is to be cut. To cut the workpiece, the operator applies an operating force 61 at the rear handle 3 and an operating force 64 at the tubular handle 5, with these operating forces counteracting the counter force 62. With a back-handed cut, the operating force 64 at the tubular handle 5 acts approximately upwardly, and the operating force 61 at the rear handle 3 acts essentially downwardly. The counter force 62 at the guide bar 6 acts against the force that acts downwardly at the upper side of the guide bar 6. Cutting forces 66 additionally act in the longitudinal direction of the guide bar 6. The cutting forces 66 are normally greater than the counter force 62. The operating forces 61 and 64, the counter force 62, and the cutting forces 66 operate in addition to forces that generate vibrations. During operation, the vibrations effect a back and forth, oscillatory relative movement of the housing 2 relative to the handle housing 21. The relative movement resulting from the operating forces 61 and 64 is supplemental and is superimposed by the vibrations. These forces cause an expansion of the vibration space 14. The handle housing 21 consequently carries out a rotation relative to the housing 2 about an imaginary axis of rotation 65, the approximate position of which is indicated in FIG. 1. When cutting to length, the active forces are reversed in direction, and the vibration space 14 is reduced in size.

The third anti-vibration element 17 and the means 32 to protect against over extension are disposed in that region of the vibration space 14 in which the relative movement between the rear handle 3 and the housing 2 is the greatest. The third anti-vibration element 17 is disposed on that side of the transverse plane 13 that faces the rear handle 3 in a region, as viewed in the direction of the longitudinal central axis 12, that is disposed between the rear handle 3 and the tubular handle 5. As a result, the third anti-vibration element 17 delimits the relative movements between housing 2 and rear handle 3.

Figure 8:
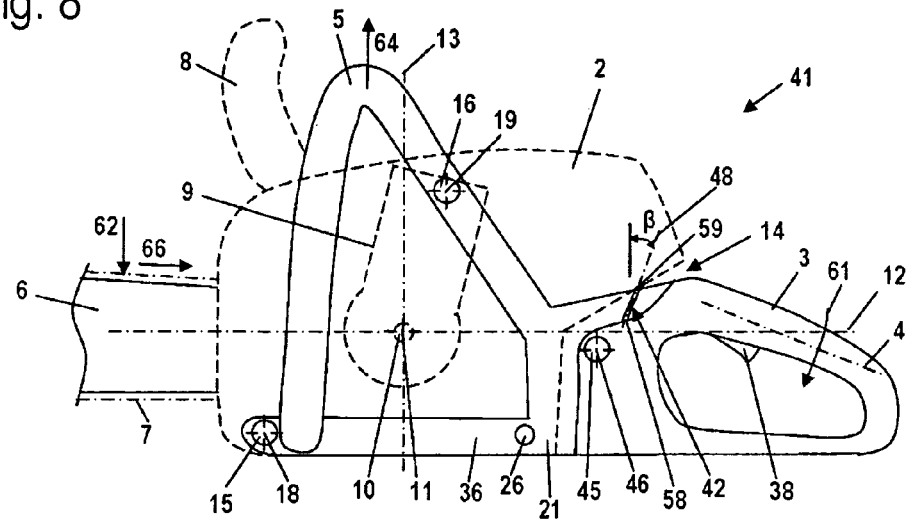
FIG. 8 is a side view of an exemplary embodiment of a power saw.

FIG. 8 shows an embodiment of a power saw 41. The construction of the power saw 41 essentially corresponds to the construction of the power saw 1 of FIG. 1. The same reference numerals characterize the same components in both figures. With the power saw 41, the arrangement of the third anti-vibration element differs from that of the power saw 1. Instead of an inclined third anti-vibration element 17, the power saw 41 has a third anti-vibration element 45, the longitudinal axis 46 of which extends parallel to the longitudinal axes 18 and 19 of the anti-vibration elements 15 and 16, and perpendicular to the longitudinal plane 60 (FIG. 2). The anti-vibration elements 15, 16 and 45 can also be inclined relative to the longitudinal plane 60 by an angle that is slightly less than 90°, resulting in an approximately perpendicular arrangement.

The third anti-vibration element 45 can, as can also the two anti-vibration elements 15 and 16, also have a means to protect against over extension that corresponds to the means 32 to protect against over extension of the third anti-vibration element 17 of the power saw 1 as shown in FIG. 7. As a connecting element, the power saw 41 has a means 42 to protect against over extension that is provided separately and independently of an anti-vibration element. A first end 58 of the means 42 to protect against over extension is secured to the handle housing 21, while a second end 59 of the means 42 is secured to the housing 2 of the power saw 41. The means 42 to protect against over extension has a longitudinal axis 48 that interconnects the two securement points of the means 42 to protect against over extension, and that is inclined by an angle β relative to the transverse plane 13 of the power saw 41. The angle β is less than 90°. The angle β is advantageously less than 80°, and in particular less than 60°. An angle β of approximately 10° to approximately 45° is advantageous.

Figure 9:
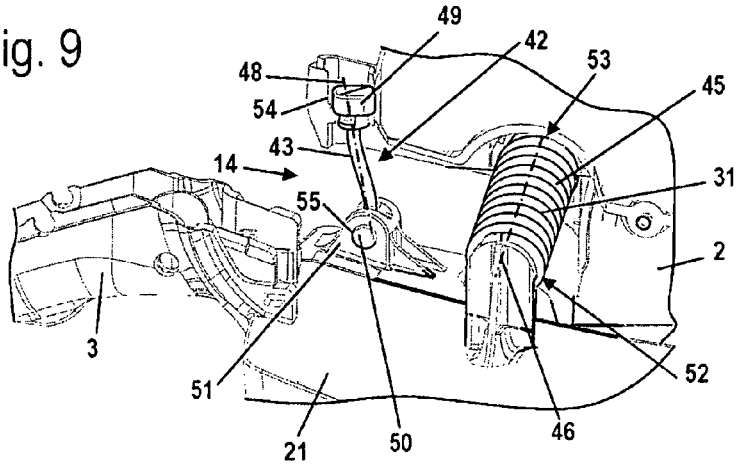
FIGS. 9-10 are perspective views of the means to protect against over extension of the power saw of FIG. 8 in different relative positions of housing and handle housing.
Figure 10:
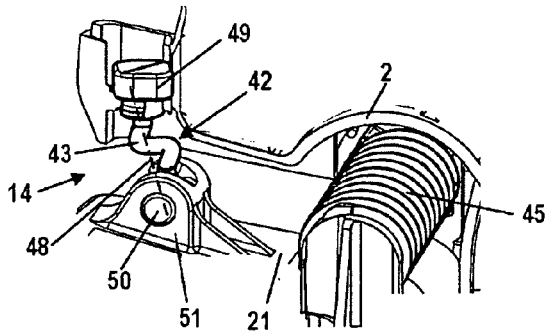
Figure 11:
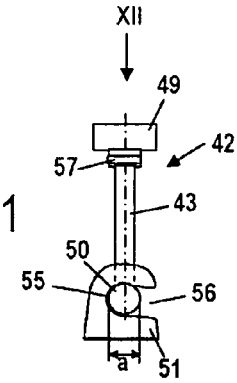
FIG. 11 is a side view of the means to protect against over extension of FIGS. 8-10, and, FIG. 12 is a plan view onto the means to protect against over extension of FIG. 11 taken in the direction of the arrow XII in FIG. 11.

The means 42 to protect against over extension, and the third anti-vibration element 45, are shown in FIGS. 9 and 10. In FIG. 9, the means 42 to protect against over extension has a maximally expanded vibration gap or space 14. FIG. 10 shows the means 42 to protect against over extension in the state of rest of the power saw 41, in other words, when no forces act on the rear handle 3 and on the guide bar 6. The angle β also changes due to the movement during operation. The indicated value ranges for the angle β refer to the no load state. As shown in FIG. 9, the means 42 to protect against over extension has an anchor or safety cable 43, which is advantageously made of polymeric material, in particular aramid or aromatic polyamide. A first connection fitting 50 and a second connection fitting 49 are secured to the safety cable 43. The connection fittings 49 and 50 are advantageously extruded or injected on the safety cable 43. In this connection, the connection fittings 49 and 50 are expediently molded about the safety cable 43. The first connection fitting 50 has a cylindrical configuration, whereby the longitudinal axis of the cylinder extends transverse to the longitudinal axis 48 of the means 42 to protect against over extension. The first connection fitting 50 is disposed in a receiving means 55 that is formed on a mounting support 51 of the handle housing 21. The mounting support 51 has two side portions between which the safety cable 43 is guided out of the mounting support 51. As shown in FIG. 11, one of the side portions of the mounting support 51 is provided with an installation opening 56 by means of which the safety cable 43 can be inserted into the region between the two side portions of the mounting support 51.

Figure 12:
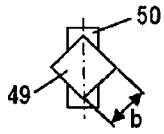

The second connection fitting 49 is disposed in a receiving means 54 on the housing 2. As shown in FIGS. 11 and 12, the first connection fitting 50 has a diameter a that is less than a smallest diameter b of the second connection fitting 49. When viewed in plan, the second connection fitting 49 has a multi sided cross-section, in the illustrated embodiment, an approximately quadratic cross-section. The smallest diameter b thus corresponds to the length of a side. Due to the fact that the diameter a of the first connection fitting 50 is less than the smallest diameter b of the second connection fitting 49, the first connection fitting 50 can be inserted in the longitudinal direction through the second receiving means 54 and can be secured in the mounting support 51. As shown in particular in FIG. 11, the second connection fitting 49 has a detent 57 via which the second connection fitting 49 is held in the housing 2. As a result, the means 42 to protect against over extension can be easily installed.

FIGS. 9 and 10 also show the arrangement of the third anti-vibration element 45. The third anti-vibration element 45 includes a coil spring 31, the ends of which are threaded onto or otherwise secured to mounting supports. The first end 52 of the third anti-vibration element 45 is secured to the handle housing 21, and the opposite, second end 53 of the element 45 is secured to the housing 2. The third anti-vibration element 45 can also be provided with an additional means to protect against over extension.

The specification incorporates by reference the disclosure of German priority document DE 10 2007 022 115.2 filed May 11, 2007.

The present invention is, of course, in no way restricted to the specific disclosure of the specification and drawings, but also encompasses any modifications within the scope of the appended claims.

What I claim is:

1. A manually guided implement, comprising:

a drive motor for driving a tool of the implement, wherein said tool extends in a forward direction at a front end of the implement, and wherein said drive motor is provided with a drive shaft that is rotatably driven about an axis of rotation;

a rear handle that extends from a rear end of the implement that faces away from the front end, wherein at least one control element for said drive motor is disposed on said rear handle, further wherein the implement has an imaginary longitudinal plane that extends perpendicular to said axis of rotation, further wherein a longitudinal axis of said rear handle is disposed in said imaginary longitudinal plane, further wherein the implement has an imaginary transverse plane that extends perpendicular to said imaginary longitudinal plane, and wherein said axis of rotation of said drive shaft is disposed in said imaginary transverse plane; and at least a first and a second anti-vibration element, wherein a vibration space is formed between said rear handle and said drive motor, further wherein said vibration space is spanned by said first anti-vibration element, which is in the form of a connecting element having a longitudinal axis that extends approximately parallel to said imaginary longitudinal plane and that is inclined relative to said imaginary transverse plane of the implement, and wherein said second anti-vibration element includes a coil spring having a longitudinal axis that extends approximately perpendicular to said imaginary longitudinal plane of the implement.

2. An implement according to claim 1, wherein the angle formed by the inclination of said longitudinal axis of said connecting element relative to said imaginary transverse plane is less than 80°.

3. An implement according to claim 2, wherein said angle is less than 60°.

4. An implement according claim 3, wherein said angle is approximately 10° to approximately 45°.

5. An implement according to claim 1, wherein said connecting element is disposed on a side of said imaginary transverse plane that faces said rear handle.

6. An implement according to claim 1, further comprising a housing in which said drive motor is disposed, wherein a first end of said at connecting element is connected to said handle, and wherein a second end of said connecting element is connected to a housing of the implement.

7. An implement according to claim 6, further comprising a tubular handle that spans said housing adjacent to a front end of said housing that faces the tool of the implement.

8. An implement according to claim 7, wherein said tubular handle and said rear handle are part of a handle housing of the implement, and wherein said first end of said connecting element is secured to said handle housing in a region between said tubular handle and said rear handle.

9. An implement according to claim 7, wherein a third anti-vibration elements is disposed perpendicular to said imaginary longitudinal plane of the implement, further wherein said second anti-vibration elements is disposed adjacent to a front end of said tubular handle, and wherein an end of said third anti-vibration elements is secured to said tubular handle.

10. An implement according to claim 1, wherein a first end of said first anti-vibration element, which is in the form of said connecting element, is secured to a handle housing, and wherein said first end is disposed further from said imaginary transverse plane than is a second end of said first anti-vibration element that is secured to a housing of the implement.

11. An implement according to claim 1, wherein said first anti-vibration element, which is in the form of said connecting element, includes a coil spring.

12. An implement according to claim 1, wherein said connecting element includes a means to protect against over extension.

13. An implement according to claim 12, wherein said means to protect against over extension is disposed in the interior of a coil spring of said first anti-vibration element.

14. An implement according to claim 1, wherein said at least one connecting element is embodied as a separate means to protect against over extension, and wherein said means to protect against over extension includes a safety cable.

15. An implement according to claim 14, wherein said safety cable is disposed at least partially in the direction of an operating force that during operation of the implement acts upon said handle, which is a rear handle.

16. An implement according to claim 14, wherein said safety cable is made of polymeric material.

17. An implement according to claim 14, wherein a respective connection fitting is disposed at opposite ends of said safety cable.

18. An implement according to claim 17, wherein the implement includes a housing in which said drive motor is disposed, further wherein the implement includes a handle housing, further wherein a first receiving means is formed on said handle housing for a first one of said connection fittings, and wherein a second receiving means is formed on said housing for a second one of said connection fittings of said safety cable.

19. An implement according to claim 17, wherein a first one of said connection fittings has a cylindrical configuration, further wherein a second one of said connection fittings has a multi-sided cross-section, and wherein a diameter of said first connection fitting is less than the smallest diameter of the multiple sides of said second connection fitting.

* * * * *